United States Patent [19]

Lew

[11] 4,163,754

[45] Aug. 7, 1979

[54] FLUORINATED SULFONAMIDES

[75] Inventor: Jean S. Y. Lew, Wilmington, Del.

[73] Assignee: ICI Americas Inc., Wilmington, Del.

[21] Appl. No.: 870,577

[22] Filed: Jan. 18, 1978

Related U.S. Application Data

[60] Continuation of Ser. No. 772,513, Feb. 28, 1977, abandoned, which is a division of Ser. No. 664,741, Mar. 8, 1976, abandoned.

[51] Int. Cl.[2] ..... C07C 143/72

[52] U.S. Cl. ..... 428/378; 260/556 AR; 260/401; 260/556 F; 428/260

[58] Field of Search ..... 260/401, 556 F, 556 AR; 427/390; 428/260

[56] References Cited

U.S. PATENT DOCUMENTS

| | | | |
|---|---|---|---|
| 2,596,925 | 5/1952 | Gunderson et al. | 260/401 |
| 2,759,019 | 8/1956 | Brown et al. | 260/556 F |
| 2,809,990 | 10/1957 | Brown | 260/534 |
| 3,301,893 | 1/1967 | Putnam et al. | 260/556 F |
| 3,519,682 | 7/1970 | Fielding | 260/556 F |
| 3,558,677 | 1/1971 | Sweeney et al. | 260/401 |
| 3,595,886 | 7/1971 | Sweeney et al. | 260/401 |
| 3,600,415 | 8/1971 | Sweeney et al. | 260/404.5 |
| 3,721,706 | 3/1973 | Hoffman et al. | 260/501.12 |
| 3,829,466 | 8/1974 | Staffe et al. | 260/556 F |
| 3,864,396 | 2/1975 | Staffe et al. | 260/553 A |
| 3,911,056 | 10/1975 | Houghton | 260/509 X |
| 3,917,691 | 11/1975 | Rey-Chaudhuri et al. | 260/556 F |

*Primary Examiner*—Winston A. Douglas
*Assistant Examiner*—J. V. Howard
*Attorney, Agent, or Firm*—H. Jolyon Lammers

[57] ABSTRACT

Novel fluorinated sulfonamides useful as water-, oil- and soil repellency agents may be prepared by reacting a $C_{12-30}$ fatty acid, polyamine and a sulfonyl halide in the presence of an organic or inorganic weak base.

11 Claims, No Drawings

FLUORINATED SULFONAMIDES

This is a continuation, of application Ser. No. 772,513 filed Feb. 28, 1977 which is a division of Ser. No. 664,741, filed Mar. 8, 1976, now abandoned.

This invention concerns novel fluorinated sulfonamides and their methods of preparation. More particularly, the invention concerns fluorinated sulfonamides prepared from the reaction of a fatty acid, polyamine and a perfluorinated alkenyl-oxy-alkylene (or arylene) sulfonyl halide hereinafter referred to as sulfonyl halide. The compounds of the reaction are substantially hard waxy solids and are useful not only as water- and oil-repellency agents but additionally exhibit low soiling characteristics when applied to fibers such as for example carpets, draperies or apparel.

DESCRIPTION OF THE INVENTION

The fluorinated sulfonamide compounds of the present invention have the structural formula:

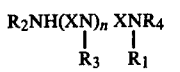

$$R_2NH(\underset{\underset{R_3}{|}}{X}N)_n\,\underset{\underset{R_1}{|}}{X}NR_4$$

wherein

X is $C_{2-10}$ alkylene optionally interrupted by one or more oxygen groups, $R_1$ is hydrogen, n is an integer from zero to four, $R_2$ and $R_4$ are a $C_{12-30}$ acyl radical or a radical having the formula $$R_fO(Y)\,SO_2-$$

in which $R_f$ is a linear or branched $C_{2-16}$ perfluoro alkenyl radical and in which Y is a $C_{2-10}$ alkylene optionally interrupted with one or more oxygen atoms or an arylene radical, where $R_3$ is independently hydrogen, a $C_{12-30}$ acyl radical or a radical having the formula $$R_fO(Y)\,SO_2-$$

wherein $R_f$ and Y have the aforestated meanings with the proviso that amongst the values of $R_2$, $R_3$ and $R_4$ there must be at least one $C_{12-30}$ acyl radical and at least one radical having the formula $$R_fO(Y)\,SO_2-$$

in which $R_f$ and Y have the aforestated meanings.

The novel compounds of the present invention are prepared by forming a $C_{2-10}$ polyamine reaction product with both a $C_{12-30}$ fatty acid and a perfluoro alkenyl-oxy-alkylene (or arylene) sulfonyl halide wherein the reaction with the fatty acid is performed at a temperature of from about 130°–180° C. and the reaction with the sulfonyl halide is performed in the presence of a weak base and at a temperature of from about 40° to 160° C. The reactants are described in further detail herein after.

Fatty Acid

The fatty acids which may be used in the formation of the compounds of the present invention have the formula:

$$C_nH_{2n+1}\,COOH$$

wherein n is an integer of 11–29 and include for example, myristic acid, palmitic acid, stearic acid and behenic acid.

Fatty acids having more than twenty four carbon atoms are generally expensive materials and are therefore not preferred due to their cost. Fatty acids having less than 14 carbon atoms may result in softer compounds and are therefore not preferred as starting materials. The compounds of the invention when used as carpet treating agents are preferably hard waxy solids since softer materials are believed to have reduced efficacy as carpet treating agents in that they may be absorbed into the warp of the carpet as opposed to remaining relatively near the surface of the nap.

A preferred range of fatty acid is therefore $C_{14-24}$ fatty acid while stearic and behenic acid are most preferred.

Polyamine

The polyamines useful in the preparation of the compounds of the invention may include di-, tri-, tetra-, penta- or hexamines. The alkyl group of the polyamines may be linear or branched and may contain from two to ten carbon atoms optionally interrupted by one or more oxygen groups. As the number of carbon atoms increases within this range, the tendency of forming soft waxy final products increases. It is therefore preferred to use $C_{2-5}$ polyamines. Moreover most polyamines having $C_{2-5}$ alkyl groups are readily commercially available and are therefore preferred for economic reasons. Useful polyamines include pentamethylenediamine, decamethylenediamine, octamethylenediamine, bis-(pentamethylene) triamine, N,N'-bis-(2-aminoethyl) hexamethylenediamine, bis-(hexamethylene) triamine, bis-(2-aminopropyl) ether of ethylene glycol, bis-(2-aminopropyl) ether of diethylene glycol. Polyamines which are more preferred for the reasons stated above include N,N'-bis-(2-aminoethyl) propylenediamine, N,N'-bis-(3-aminopropyl) ethylenediamine, N,N'-bis-(3-aminopropyl) propylenediamine, tripropylenetetramine, dipropylenetriamine, pentaethylenehexamine, tetraethylenepentamine, propylenediamine and ethylenediamine. Most preferred polyamines are diethylene triamine and triethylene tetramine.

Sulfonyl halides

The sulfonyl halides used as a coreactant in the invention are perfluorinated alkenyl-oxy-alkylene (or arylene) sulfonyl halide and may be branched or linear in nature. They may be prepared according to several methods known in the art. For example perfluorinated alkenyl-oxy-arylene sulfonyl halides may be prepared according to the teaching in UK Pat. No. 1,366,691 by reacting a perfluoro alkylene, such as for example tetrafluoro ethylene, with a phenol to form a perfluoro alkenyl oligomer phenyl ether. The product so formed is then reacted with halosulfonic acid to form the sulfonyl halide. The perfluoro alkenyl group has the formula $C_pF_{2p-1}$ wherein p is an integer of from 2 to 16. Perfluoro alkenyl group which are preferred for economic reasons are those wherein p is 8, 10 or 12.

The perfluorinated alkenyl-oxy-alkylene sulfonyl halides may be prepared by a reaction between a perfluoro alkylene and an alcohol which is capable of subsequent halosulfonation such as for example isobutyl alcohol and reacting the product so formed with a halo sulfonic acid such as chlorosulfonic acid to obtain the perfluorinated alkenyl-oxy-alkenyl sulfonyl halide.

Useful sulfonyl halides have for example the following formulas:

$C_{10}F_{19}OC_6H_4SO_2Cl$ $C_8F_{15}OC_6H_4SO_2Cl$ $C_{12}F_{23}OC_6H_4SO_2Cl$ $C_{10}F_{19}OC_2H_4OC_4H_8SO_2Cl$ $C_8F_{15}OC_4H_8SO_2Cl$

The preferred perfluorosulfonyl halides are perfluorodecenyloxybenzenesulfonyl chloride, perfluorooctenyloxybenzenesulfonyl chloride, perfluorododecenyloxybenzenesulfonyl chloride, perfluorododecenyloxyisobutylenesulfonyl chloride and perfluorodecenyloxyethyleneoxyisobutylenesulfonyl chloride.

Weak Base

Since some hydrogen chloride is released during the reaction it is recommended to add a weak base to the reaction mixture for the purpose of neutralizing the acid. Any weak base which fulfills this function will be acceptable. Preferred bases include triethylamine, pyridine, sodium methoxide, and sodium or potassium carbonate.

It may be desirable to have an inert organic solvent present during the reactions to provide greater solubility for the reactants. Generally any solvent employed herein has a lower boiling point than the boiling point of the reactants. Any organic liquid which is capable of solubilizing the amine reactant in particular and which is inert to the reactants and the products of the reaction may be employed. Suitable inert, organic solvents include ethers such as dioxane, diethylether, diisopropyl ether, tetrahydrafuran and hydrocarbons such as heptane, benzene, toluene and xylene. Naturally if the alkyl polyamines selected for the reaction is a liquid there is little need to have an additional solvent present.

Reaction

The preferred reaction takes place in two stages. In the first stage the fatty acid is reacted with the polyamine at a temperature of about 130° to 180° C. To increase the solubility of the reactants and the rate of reaction there may be added an optional inert solvent. In the second stage of the reaction the fluorinated sulfonyl halide is added to the reaction mixture of the first stage while maintaining a reaction temperature of about 40° to 160° C. Again an inert solvent may also be present during the second stage of the reaction. If desired the sequence of reactions may be varied by for example reacting the polyamine and sulfonyl chloride in a first stage and adding the fatty acid reactant in a second stage. Purification of the product may be effected by water washing or filtration. Inert solvents which may optionally be present in either stage of the reaction may be stripped off to yield the hard solid product of the invention.

The relative molar amounts of starting materials may vary widely depending on the alkyl polyamine selected but should include for each mol of amine at least one mol of fatty acid and one mol of sulfonyl chloride and the molar proportions of fatty acid and sulfonyl chloride combined should not exceed the number of amine equivalents. For example, for each mol of alkyl diamine selected there should be used one mol of fatty acid and one mol of sulfonyl halide, alternatively for each mol of alkyl hexamine selected there may reacted from one to five mols of fatty acid and from one to five mols of sulfonyl halide as long as in this instance the total amounts of mols of fatty acid and sulfonyl halide are in the range of 2 to 6.

Using molar proportions outside the above suggested range may result in a less active final product due to the presence of relatively inert unreacted or partially unreacted starting materials.

The efficacy of the compounds of the invention as fiber treating agents may readily be determined by treating a fibrous material with the compound and observing that the treated material is not wetted by water or oil. Its soil repellency properties may be determined by comparative soil wearing tests which tests will readily indicate the utility of the compounds of the invention.

To illustrate more particularly the products and process of the invention, the following examples are included, while the examples in general utilize reactants in about equal molar amounts, the reacting amounts may be varied to yield a variety of products useful within the scope of the invention.

EXAMPLE 1

114 g (0.4 mol) of stearic acid and 41.3 g (0.4 mol) of diethylenetriamine was reacted at 160°-172° C. until 0.4 mol of water was evolved (18 minutes). To 55.5 g (0.15 mol) of the resulting diethylenetriamine monostearamide was added 101 g (0.15 mol) of a branched perfluorodecenyloxybenzene chloride with the structure

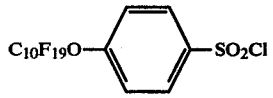

and 8.8 g of sodium carbonate. The mixture was reacted at 80°-130° C. for ½ hour. The reaction mixture was then stripped of volatiles to 130° C. and 20 mm mercury pressure. The product was dissolved in perchloroethylene and the sodium chloride was removed by filtration. The solvent was stripped from the filtrate to yield the product, the monoperfluorodecenyloxybenzene sulfonamide of diethylenetriamine monostearamide, a tan hard waxy solid. Filter paper treated with this compound was not wetted by water or oil. The compound exhibited good soil resistant properties.

EXAMPLE 2

The procedure of example 1 may be repeated while replacin the 0.15 mol of perfluorodecenyloxybenzenesulfonyl chloride with 0.15 mol of perfluorodecenyloxyethyleneoxyisobutylenesulfonyl chloride to obtain compounds having good water-, oil- and soil resistant properties.

EXAMPLE 3

Behenic acid (131.2 g, 0.4 mol) and diethylenetriamine (41.7 g, 0.4 mol) was reacted as in Example 1 to product diethylenetriamine monobehenamide. To 61.8 g (0.15 mol) of this product was added 101 g (0.15 mol) of perfluorodecenyloxybenzenesulfonyl chloride and 8.8 g of sodium carbonate and the reaction was carried out in a similar manner to Example 1. The product, monoperfluorodecenyloxybenzene sulfonamide diethylenetriamine monobehenamide, is a tan, hard waxy solid with good oil and water reepellency, as shown by the resistance of treated filter paper to wetting by oil and water. The compound exhibited good soil resistance properties.

EXAMPLE 4

To 33.0 g (0.08 mol) of diethylenetriamine monobehenamide obtained in Example 3 was added 80.6 g (0.12 mol) of perfluorodecenyloxybenzene sulfonyl chloride and 6.7 g of sodium carbonate. The mixture was reacted in a similar manner to Example 1 except that the temperature used was 70°-115° C. The resulting product, the sesquiperfluorodecenyloxybenzene sulfonamide of diethylenetriamine monobehenamide is a tan, hard, waxy solid, with good oil and water repellance, as shown by the resistance of a treated glass surface to wetting by oil and water. The compound exhibited good soil resistance properties.

EXAMPLE 5

28.9 g (0.07 mol) of the diethylenetriamine mononehenamide obtained in Example 3 was dissolved in 45 ml. of perchloroethylene at 75° C. A mixture of 84.5 g (0.126 mol) of perfluorodecenyloxybenzenesulfonyl chloride and 7.8 g of sodium carbonate was added over a period of one hour while holding the reaction mixture at 85°-95° C. A vacuum was then applied to strip off the solvent to a temperature of 120° C. at 30 mm Hg pressure. The product was dissolved in perchloroethylene and the sodium chloride was removed by filtration, and the solvent stripped from the filtrate to yield the product, a 1.8 perfluorodecenyloxybenzene sulfonamide of diethylenetriamine monobehenamide, a tan, hard, waxy solid with good oil, water and soil repellancy.

EXAMPLE 6

Behenic acid (131 g, 0.4 mol) and triethylene tetramine (29.2 g, 0.2 mol) was reacted at 155°-164° C. until 0.4 mol of water had been evolved (½ hour). To the resulting triethylenetetramine dibehenamide (38.3 g, 0.05 mol), dissolved in 80 ml. of perchloroethylene at 90° C., was added a mixture of perfluorodecenyloxybenzene sulfonylchloride (67.2 g, 0.1 mol) and sodium carbonate (5.8 g) over a period of 45 minutes while the temperature was held at 90°-95° C. After another 15 minutes at 95° C., the mixture was stripped to 120° C. at 30 mm Hg pressure. The product was dissolved in perchloroethyle and the solution was decanted from the sodium chloride. The solven was then removed by distillation to yield the product, the bisperfluorodecenyloxybenzene sulfonamide of triethylenetetramine dibehenamide, a tan, hard, waxy solid, with good oil, water and soil repellancy.

EXAMPLE 7

Behenic acid (98.4 g., 0.3 mol) and triethylenetetramine (43.8 g, 0.3 mol) was reacted at 158°-161° C. until 0.3 mol of water had been evolved (25 minutes) 47.4 g (0.1 mole) of the resulting triethylenetetramine monobehenamide was dissolved in 50 ml. of perchloroethylene. To the resulting solution was added a mixture of 80.0 g (0.12 mol) of perfluorodecenyloxybenzenesulfonyl chloride and 7.0 g of sodium carbonate over a 20 minute period, while holding the temperature at 95°-120° C. After one hour at 90°-120° C., the mixture was worked up as in the preceding example to yield the product, 1.2 perfluorodecenyloxybenzenesulfonamide of triethylene tetramine monobehenamide, a tan, hard, waxy, solid with good oil, water and soil repellancy.

EXAMPLE 8

Stearic acid (285 g, 1 mol) and triethylenetetramine (146 g, 1 mol) was reacted at 163°-166° C. until one mole of water was evolved (28 minutes). To 20.0 g (0.05 mol) of the resulting triethylenetetramine monostearamide dissolved in 200 ml. of toluene was added a mixture of 80.7 g (0.12 mol) of perfluorodecenyloxybenzene sulfonyl chloride and 7.0 g of sodium carbonate over a period of 15 minutes while the temperature was held at 75°-80° C. After ½ hour more at 85° C., the solution was decanted from the sodium chloride and the solvent was removed by distillation to yield the product, 2.4 perfluorodecenyloxybenzenesulfonamide triethylenetetramine monostearamide, a tan, hard, waxy, solid with good water, oil and soil repellancy.

EXAMPLE 9

7.3 g of triethylenetetramine (0.05 mol) in 30 ml. of toluene was heated to 75° C. and a mixture of 5.3 g of sodium carbonate and 67.3 g of perfluorodecenyloxybenzene sulfonyl chloride was added over a period of 20 minutes while maintaining the temperature at 80° C. After half an hour of further reaction at 80°-90° C., the reaction mixture was stripped of solvent to a temperature of 150° C. and 45 mm mercury pressure. There was then added 16.4 g of behenic acid (0.05 mol) and 30 ml. of toluene and the mixture was reacted at 115°-120° C. until 0.05 mol of water had evolved (1¼ hours). The solvent was then stripped to a temperature of 100° C. and 30 mm. mercury pressure to yield the product, triethylenetetramine bis-(perfluorodecenyloxybenzene sulfonamide) monobehenamide, a tan, hard solid with good oil, water and soil repellancy.

What is claimed is:

1. A fluorinated sulfonamide compound having formula:

$$R_2NH(\underset{\underset{R_3}{|}}{XN})_n\,\underset{\underset{R_1}{|}}{XNR_4}$$

wherein

X is $C_{2-10}$ alkylene optionally interrupted by one or more oxygen groups, $R_1$ is hydrogen, n is an integer from zero to four, $R_2$, and $R_4$ are a $C_{12-30}$ acyl radical or a radical having the formula $$R_fO(Y)SO_2—$$

in which $R_f$ is a linear or branched $C_{2-16}$ perfluoro alkenyl radical and in which Y is a $C_{2-10}$ alkylene optionally interrupted with one or more oxygen atoms or an arylene radical, where $R_8$ is independently hydrogen, a $C_{12-30}$ acyl radical or a radical having the formula $$R_fO(Y)SO_2—$$

wherein $R_f$ and Y have the aforestated meanings with the proviso that amongst the values of $R_2$, $R_3$ and $R_4$ there must be at least one $C_{12-30}$ acyl radical and at least one radical having the formula $R_fO(Y)SO_2$— in which $R_f$ and Y have the aforestated meanings.

2. A compound as claimed in claim 1 wherein X is a $C_{2-5}$ alkylene radical.

3. A compound as claimed in claim 1 wherein Y is an arylene radical.

4. A compound as claimed in claim 1 wherein n is zero.

5. A compound as claimed in claim 1 wherein $R_2$, $R_3$ or $R_4$ is $C_{14-24}$ acyl radical.

6. A method of treating a fiber which comprises depositing onto said fiber a coating of a compound as claimed in claim 1.

7. A method as claimed in claim 6 wherein the fiber is a carpet fiber.

8. A fiber having a coating of a compound as claimed in claim 1.

9. A fiber as claimed in claim 8 wherein the fiber is a carpet fiber.

10. A method for preparing a fluorinated sulfonamide as claimed in claim 1 which comprises forming a $C_{2-10}$ polyamine reaction product with both a $C_{12-30}$ fatty acid and a perfluoro alkenyl-oxy-alkylene (or arylene) sulfonyl halide wherein the reaction with the fatty acid is performed at a temperature of from about 130°–180° C. and the reaction with the sulfonyl halide is performed in the presence of a weak base and at a temperature of from about 40° to 160° C.

11. A method as claimed in claim 10 wherein diethylenetriamine is reacted first with behenic acid and the product so formed is reacted with perfluorodecenyloxybenzene sulfonyl chloride.

* * * * *

UNITED STATES PATENT AND TRADEMARK OFFICE

CERTIFICATE OF CORRECTION

PATENT NO. : 4,163,754

DATED : August 7, 1979

INVENTOR(S) : Baak W. Lew

It is certified that error appears in the above-identified patent and that said Letters Patent are hereby corrected as shown below:

Column 6, line 60, "$R_8$" should read --$R_3$--.

Inventor should read
--Baak W. Lew deceased, late of Wilmington, Delaware by Jean S. Y. Lew, personal representative Signed and Sealed this

*Sixth* Day of *November 1979*

[SEAL]

*Attest:*

RUTH C. MASON
*Attesting Officer*

LUTRELLE F. PARKER
*Acting Commissioner of Patents and Trademarks*